US005540023A

United States Patent [19]

Jaenson

[11] Patent Number: 5,540,023

[45] Date of Patent: Jul. 30, 1996

[54] LATHING

[75] Inventor: Howard W. Jaenson, Covina, Calif.

[73] Assignee: Jaenson Wire Company, Fontana, Calif.

[21] Appl. No.: 479,136

[22] Filed: Jun. 7, 1995

[51] Int. Cl.[6] ..... E04F 13/04

[52] U.S. Cl. ..... 52/343; 52/344

[58] Field of Search ..... 52/342–344

[56] References Cited

U.S. PATENT DOCUMENTS

| | | | |
|---|---|---|---|
| 528,931 | 11/1894 | Eils | 52/343 |
| 539,394 | 5/1895 | Poulson et al. | 52/343 |
| 2,903,880 | 9/1959 | Johnson | 52/344 |

FOREIGN PATENT DOCUMENTS

| | | | |
|---|---|---|---|
| 692740 | 8/1964 | Canada | 52/342 |
| 422237 | 3/1911 | France | 52/343 |
| 1260108 | 3/1961 | France | 52/342 |
| 683625 | 4/1994 | Germany | 52/342 |

*Primary Examiner*—Carl D. Friedman

*Assistant Examiner*—Beth A. Aubrey

*Attorney, Agent, or Firm*—Christie, Parker & Hale, LLP

[57] ABSTRACT

Self-furring, welded wire lathing includes a flexible paper support material disposed substantially in a vertical plane and having horizontally spaced-apart openings cut therethrough. The openings are arranged in parallel horizontal rows, with the spacing between adjacent openings in each horizontal row defining intervening webs of support paper therebetween. A metal reinforcing grid is interwoven with the support material, and includes a regular array of horizontal and vertical wires which are welded together at their intersections, with each such weld in registry with one of the openings. The vertical wires are arranged across the front face of the support material, while the horizontal wires are arranged in two wire courses; a first horizontal wire course arranged across the front face of the support material and a second horizontal wire course arranged across the back face of the support material. The wires of the second horizontal wire course engage the paper webs to thereby attach the support material to the wire grid. The wires of the first horizontal wire course are held away from the support material by furring crimps in the vertical wires, thus allowing a full thickness of plaster to be applied between the support paper and the wire mesh to the depth of the fur.

19 Claims, 4 Drawing Sheets

LATHING

FIELD OF THE INVENTION

The present invention relates to lathing and in particular to self-furring lathing of a welded wire mesh type having furring crimps located at spaced-apart intervals to space the lathing material from the framing members to which the lathing material is to be attached.

DESCRIPTION OF THE PRIOR ART

Self-furring, welded wire lathing is well known and has found wide application, particularly in multi-story residential and commercial construction. Welded wire lathing provides a wire reinforcing mesh for portland cement or stucco plastering intended for both interior and exterior applications. A typical self-furring welded wire lathing product currently in use is shown in FIGS. 1–3.

Turning particularly to FIG. 1, the relative positions of components of the prior art welded wire lathing are described as they are shown in FIG. 1, with the lathing in a vertical plane, the front of the lathing facing outward and the rear, or back, of the lathing facing inward. The lathing comprises a wire reinforcing fabric which includes horizontal wires 10 and vertical wires 12, welded together at their points of intersection to form a regular mesh or grid of typically 2"×2" wire rectangles.

A sheet of absorbent support paper 14 is interwoven through the wire mesh. The support paper includes, generally, oblong shaped longitudinal openings or slots 16 which are horizontally spaced-apart and arranged in parallel rows. In the prior art lathing of FIG. 1, the slots 16 of any one row are uniformly horizontally offset with respect to the slots of the adjacent rows such that intervening webs 18 of paper material between successive slots of one row substantially oppose the centers of the slots of immediately adjacent rows. This pattern is repeated at every second horizontal interval, and is carried throughout the height of the sheet of lathing material.

The relationship between the support paper and the wire mesh is such that the longitudinal axis of a row of slots generally coincides with a horizontal wire of the mesh. In practice, the mesh is constructed by arranging the horizontal wires along the back surface of the support paper so that they span the elongated openings longitudinally. The vertical wires are arranged on the front surface of the support paper so that they span the elongated openings transversely to their long axis. The vertical wires are then welded to the horizontal wires at their points of intersection, which are in registry the elongated openings.

Confronting ends of successive slots which comprise a row are spaced-apart from each other in order to define intervening webs 18 of paper material. When the horizontal and vertical wires are welded together, the support paper webs 18, lap over the frontward facing portions of the horizontal wires which span the corresponding row of slots. The webs 18 thereby engage the horizontal wires and tend to pull the support paper toward the rearward facing portions of the vertical wires. The absorbent support paper is therefore secured between the horizontal and vertical wires of the mesh and is considered interwoven therethrough.

In certain applications, welded wire lathing material includes a waterproofed backing paper 20 which is spot-glued, or otherwise adhesively secured, to the back side of the absorbent support paper. Lathing of this latter type is used in both interior and exterior applications where a waterproof material between the lathing and a horizontal or vertical surface is required.

Particularly with regard to waterproofed lathing, the welded wire mesh is constructed to include a self-furring feature in which the vertical wires of the mesh are indented, or bent, into furring crimps 22 at regular intervals along the length of the vertical wire. The furring crimps 22 function as spacers which, when the lathing is attached to framing material, spaces the raised portions of the vertical wires, and the horizontal wires welded thereto, away from the plane of the frames by a distance equal to the depth of the fur. The lathing is self-furring in that the spacer, or fur, is integral to the lathing and not provided by a wooden furring strip, or the like.

According to building code requirements, furring crimps are provided along the vertical wires at intervals corresponding to approximately every third or fourth horizontal wire comprising the mesh, preferably every third horizontal wire (every 6 inches). The horizontal wires, in the intervals chosen, are welded to the vertical wires at the bottom **22*a* of the crimps 22**. Also, according to building codes, the furring crimps are ¼ inch in depth, which is intended to space the bulk of the wire mesh ¼ inch away from framing material.

In use, prior art lathing is attached to wood or metal framing members, or studs, 24 by various kinds of fasteners, including screws, nails, clips, tie-ons, or the like. Lathing is commonly attached to a framing stud by fastening the horizontal wires which are welded to the bottoms **22*a* of the furring crimps 22 to the stud material. Since the wires at each horizontal/vertical intersection are welded together, the horizontal wires welded to the furring crimp bottoms 22*a*** are in one plane (the plane of the framing members), while the horizontal wires welded to the raised portions of the vertical wires are in another plane. Thus, the bulk of the wire reinforcing fabric lies in a plane which is displaced away from the plane of the framing members by a distance equal to the depth of the furring crimps.

A quantity of plaster, mortar, or stucco is then applied to the attached lathing by, for example, troweling or pressure spraying. The mechanical pressure of the application causes the plaster, mortar, or stucco to force the absorbent support paper away from the vertical wires of the reinforcing mesh. The application pressure also forces the paper away from those portions of the horizontal wires not covered by the support paper webs. The plaster or stucco then flows around the vertical wires and the exposed portions of the horizontal wires, thereby embedding them in the plaster material.

A typical exterior plaster or stucco application is performed by sequentially applying three separate plaster or stucco coats; (1) a scratch coat, typically ¼" in thickness, which corresponds to the depth of the furring crimp, (2) a brown coat, which adds bulk to the plaster or stucco layer, and (3) a finish coat, which often includes additional plaster, to give a smooth finish to the final layer surface. The total thickness of the plaster/stucco application is between about ¾" to about ⅞" of an inch.

For a successful three-coat plaster/stucco application, each coat is important. However, emphasis must be placed on the integrity of the initial scratch coat. The wire reinforcing mesh of the lathing material is intended to be embedded in the scratch coat and provide it with the strength to carry the weight of a level and uniform brown and finish coat. In addition, the lathing and plaster combination is intended to provide a certain structural strength to the exterior of the building. The lath and plaster coat must meet building codes which set requirements for allowable shear values for lath attachment to particular wall structures. Since plaster alone is a relatively brittle material, a considerable portion of the required shear strength is provided by the reinforcing wires of the lathing material which are embedded in the scratch coat. It is, therefore, highly advantageous for as much of the metal reinforcing mesh as possible to be embedded as far as possible into the scratch coat, preferably, all the way to the depth of the furring crimp.

Prior art lathing material of the above-mentioned type is deficient in certain respects, however, because prior art lathing material is constructed with each of the horizontal wires configured to span the backside surface of the absorbent support paper. As will described in more detail below, this construction does not allow the entire length of the horizontal wires to be embedded in the scratch coat, nor does it allow those portions which are embedded to be embedded to any great depth.

Referring to FIG. 2*a*, there is shown a cross sectional view of the prior art lathing depicted in FIG. 1, before the application of a plaster coat. As depicted in FIG. 2*a*, the support paper 14 is woven through the rectangular wire mesh such that the paper webs 18, between the slots, lap over the front surfaces of the horizontal wires 10, thereby pulling the absorbent support paper toward the back side of the wire mesh. When the lathing is installed to a framing stud, the support paper, and the backing paper fixed thereto, remains biased against the back side of the wire mesh, and is not allowed to fall away from the mesh to lie co-planar with the bottom of the furring crimps and the framing studs.

When the scratch coat is applied, the troweling pressure cannot force the support paper away from either the vertical or the horizontal wires to the depth of the furring crimp, because the support paper is held closely adjacent the back side of the mesh by the interwoven webs of paper material. The purpose of the fur is thereby partially defeated because neither the vertical nor the horizontal reinforcing wires can be fully embedded in the plaster to a depth equalling the intended fur. Moreover, those portions of the horizontal wires covered by the paper webs 18 cannot be embedded in the plaster to any depth. The webs prevent the plaster from coming into contact with the horizontal wire portions directly beneath them and, consequently, from flowing around the wires in those regions.

This lack of embedment can be understood by referring to FIG. 2*b*, which is a partial cross-sectional view of prior art lathing material shown after the application of the scratch coat. The scratch coat 26 is applied to a thickness which ideally would embed the wire mesh in the applied plaster to the depth of the fur. The scratch coat is applied until the surfaces of the vertical wires are just barely exposed. Because the furring crimps are ¼ inch deep, it is therefore presumed that if the plaster just covers the raised wire portions, the plaster coat is ¼ inch thick.

As shown in the figure, the crimped portions 22 of the vertical wire 12 are covered by plaster material to the depth of the fur while the remaining raised portions of the vertical wires are embedded in a thickness of plaster substantially less than the depth of the fur. While it would be desired that troweling pressure force the composite paper material away from the wire mesh to result in a uniform, ¼ inch thick scratch coat, thereby embedding all of the vertical wires to the depth of the fur, this does not happen.

In the illustrated prior art, the backing and support paper are not readily displaced away from the wire mesh under the normal troweling pressure of a plaster application against the paper material. Commonly, the paper composite is displaced only about ⅛ of an inch, on average, away from the raised portions of the vertical wires 12, by pressure of the plaster material against the support paper, and by about the same amount away from the exposed portions of the horizontal wires 10 (those portions not covered by the paper webs 18), by pressure against the backing paper through the elongated horizontal slots. The webs 18 of the support paper, which overlap the horizontal wires, resist the troweling pressure and will not allow the paper material to be displaced from the horizontal wires in those regions.

Because the plaster coat can only embed itself around the portions of the horizontal wires which are exposed in the elongated openings, the horizontal wires cannot be fully embedded along their lengths in the plaster material. Thus, only certain portions of the horizontal wires, and the vertical wire portions attached thereto, bear the weight and load of the three-coat plaster.

Therefore, in many cases, prior art lathing material is unable to add sufficient structural strength to a plaster coat to enable the plaster coat to provide sufficient shear strength to a structure. In earthquake prone areas, in particular, lathe and plaster buildings must withstand a particularly large shear forces. In certain instances, plaster walls have shorn away from the building framing members, exposing still attached lathing material whose wires were insufficiently embedded in the plaster to retain it in place.

SUMMARY OF THE INVENTION

Welded wire lathing of the self-furring type is provided in accordance with practice of principles of the present invention. The self-furring lathing is constructed in a manner that enables substantially the entire lengths of the vertical wires to become embedded in plaster to provide uniformly strong reinforcement in two directions throughout the area of the lathing.

The self-furring lathing comprises a flexible support material having front and back faces and disposed in a plane. The support material includes longitudinally spaced-apart elongated openings arranged in parallel rows Confronting ends of the openings are spaced-apart in order to define intervening webs of support paper material therebetween. A metal reinforcing mesh is interwoven with the support material and includes horizontal and vertical wires disposed in equally spaced-apart perpendicular relation and welded together at their intersections. The vertical wires span the openings transversely on the front face of the support material and the horizontal wires span the openings longitudinally. The horizontal wires comprise a first wire course which spans the openings along the front face of the support material and a second wire course which spans the openings along the back face of the support material. The second wire course thereby engages corresponding intervening webs and attaches the support material to the wire mesh.

In one aspect of the invention, the vertical wires comprise alternating crimped portions and flat portions, the crimped portions forming substantially v-shaped indentations which intersect the second horizontal wire course at the bottoms thereof. The first horizontal wire course and the vertical wire flat portions together define a plane displaced from the plane of the support material by a distance equal to the depth of the crimped portion. The distance between the planes is sufficient to allow the vertical wire flat portions and the first horizontal wire course to be completely embedded along substantially their entire lengths in an application of mortar.

BRIEF DESCRIPTION OF THE DRAWINGS

These and other features, aspects, and advantages of the present invention will be more fully understood when considered with respect to the following detailed description, appended claims, and accompanying drawings, wherein:

DETAILED DESCRIPTION OF THE INVENTION

Figure 1:
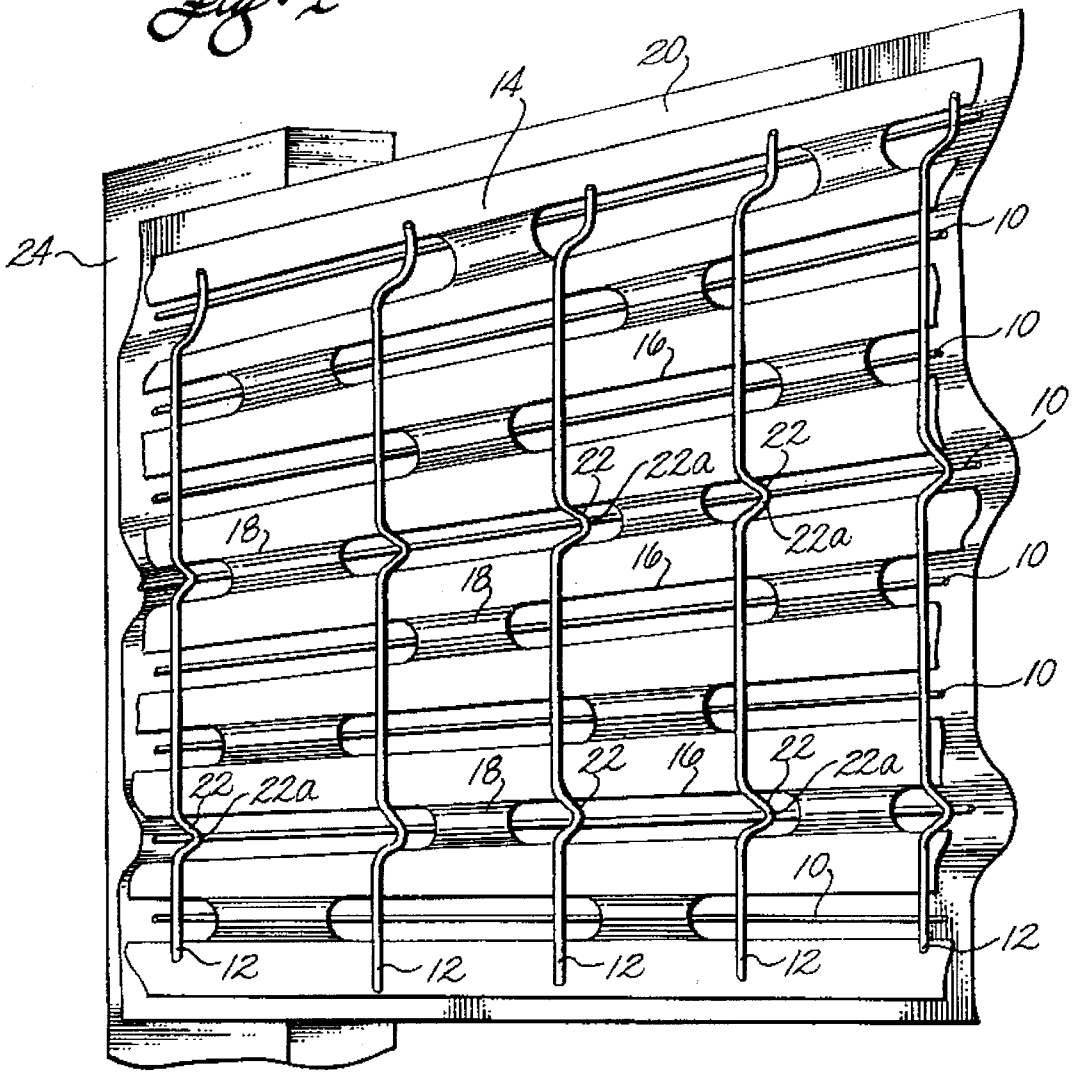
FIG. 1 is a semi-schematic perspective view of self-furring, welded wire, lathing material according to the prior art having an absorbent support paper layer interwoven through a wire reinforcing mesh.
Figure 2A:
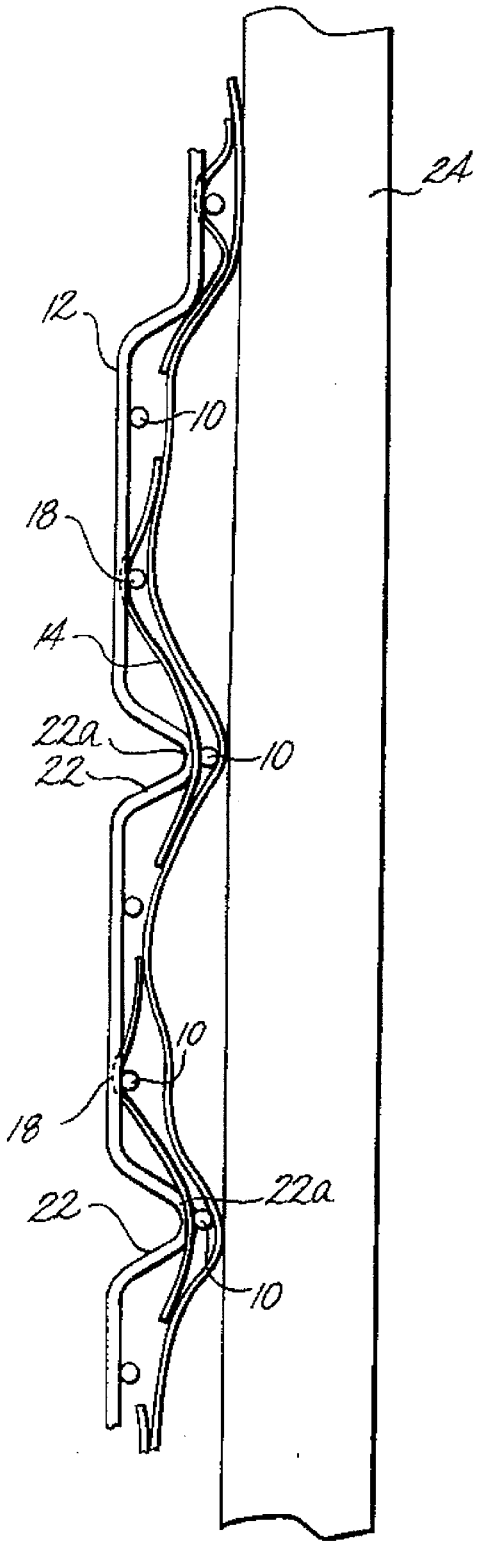
FIG. 2*a* is a semi-schematic cross-sectional view of lathing material according to the prior art before the application of plaster.
Figure 2B:
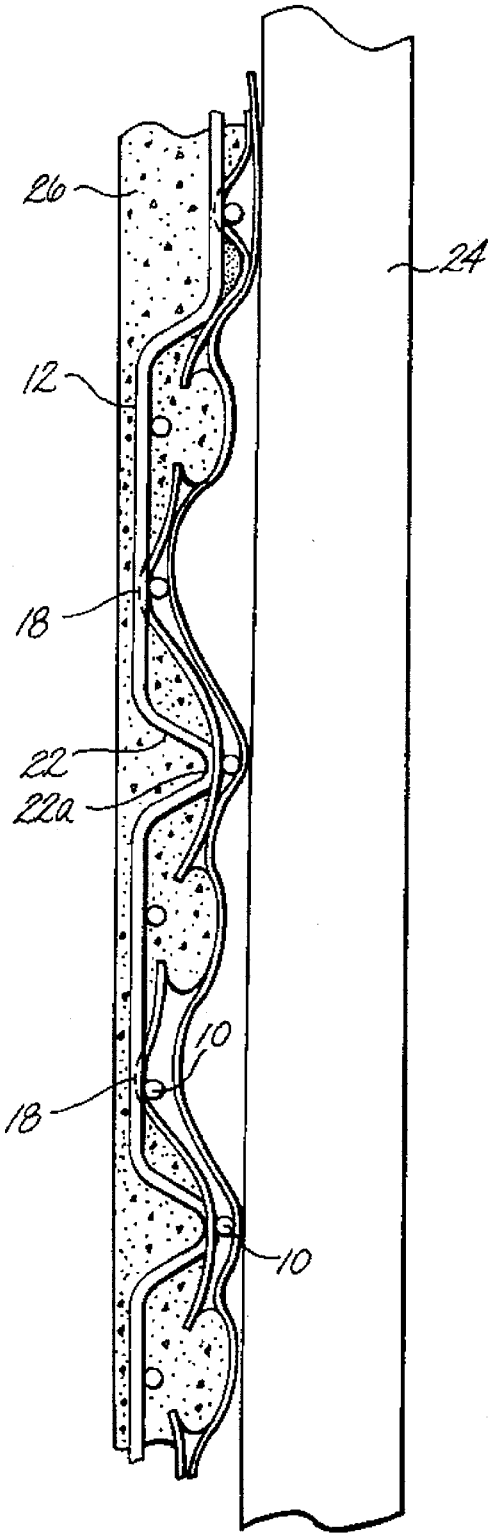
FIG. 2*b* is a semi-schematic cross-sectional view of the lathing material illustrated in FIG. 2*a* after the application of a plaster scratch coat.
Figure 3:
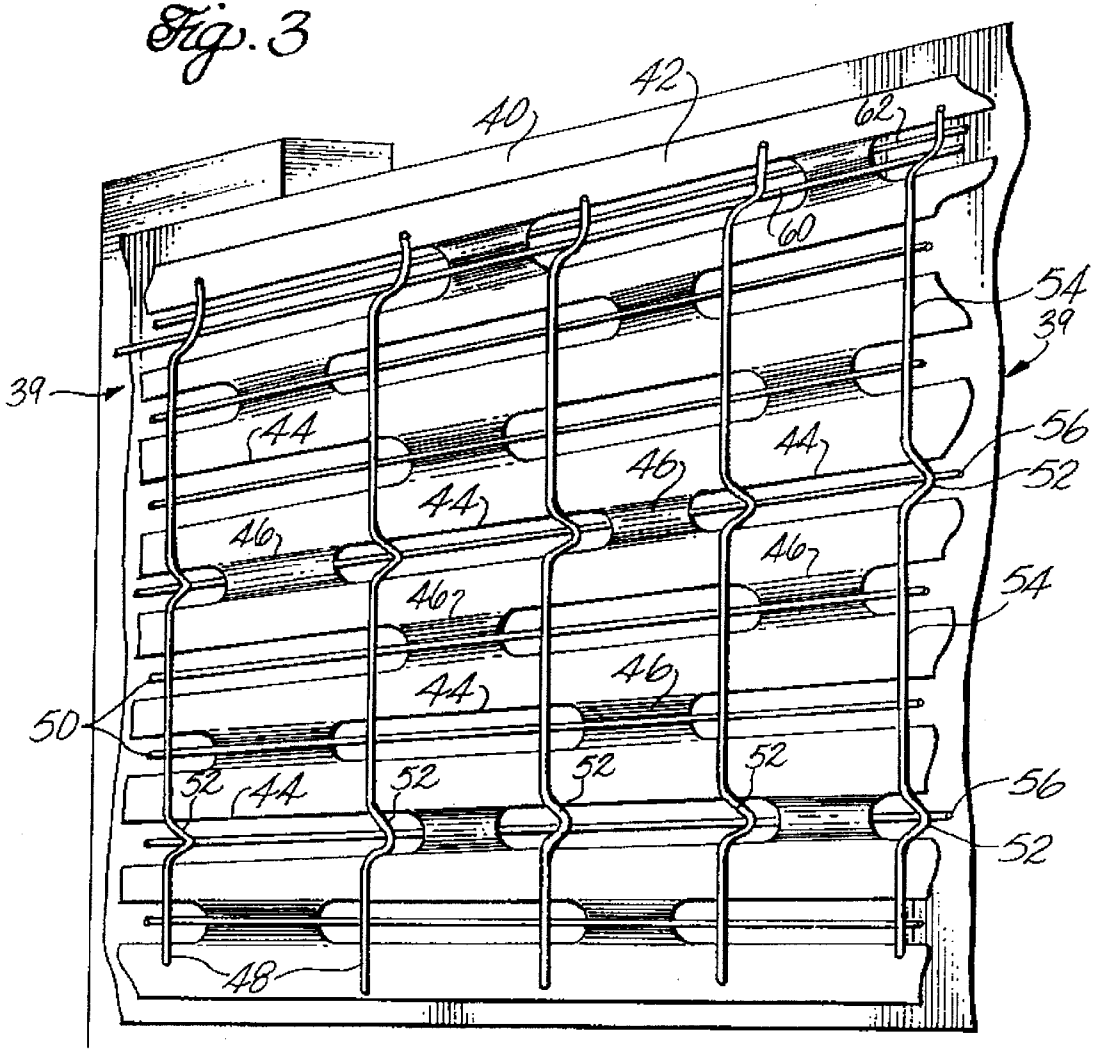
FIG. 3 is a semi-schematic perspective view of self-furring, welded wire, lathing material provided in accordance with the invention.

Turning to FIG. 3, a preferred embodiment of self-furring, welded wire lathing 39 provided in accordance with practice of the present invention is shown. The relative positions of components of the welded wire lathing of the illustrated embodiment are described as they are shown in FIG. 3, with the lathing in a vertical plane, the front of the lathing facing outward and the rear, or back, of the lathing facing inward.

The welded wire lathing of the present invention includes, generally, the same components as prior art welded wire lathing; namely, a thin, flexible, support material reinforced with a metal fabric or mesh, but arranged in a different manner. The reinforcing mesh is constructed of two series of parallel wires arranged at right angles to one another and welded together at their crossing points.

The support material suitably comprises a backing layer 40 adhesively secured to the rearward facing surface of a paper separator layer 42. The backing layer 40 preferably comprises a water-proofed building paper of the type meeting federal specification QQL-101*c*, UUE-970*a*, for backing material for plastering over wood and metal framing on vertical, horizontal, sloping and curved surfaces, and is provided as a vapor barrier. The backing layer 40 is adhesively secured, by laminating, spot-gluing, or the like, to a paper separator layer 42 which is constructed from a suitable, flexible, sheet material, preferably an absorbent paper.

The paper separator 42 is provided throughout its area with precut elongated apertures, or slots 44, defining relatively narrow slots, which extend horizontally and are arranged end-to-end in uniformly spaced parallel rows. Confronting ends of successive apertures, or slots, in a horizontal row, are spaced apart from each other to form intervening webs 46 of paper separator material which, in practice, are approximately ½ to ¾ of an inch in length. The longitudinal dimension of the slots is from about 3½ inches to about 3¾ inches. The center to center spacing of successive slots in a horizontal row is approximately 4 inches.

In the exemplary embodiment of FIG. 3, the slots 44 of any one row are uniformly horizontally offset with respect to the slots of the adjacent rows such that the intervening webs 46 are staggered to substantially oppose the centers of the slots of immediately adjacent rows. This pattern is repeated at every second horizontal interval, and is carried throughout the height of the sheet of lathing material.

A wire reinforcing mesh is interwoven with the paper separator 42. The reinforcing mesh suitably comprises a plurality of spaced-apart vertical wires 48 and spaced-apart horizontal wires 50 which intersect at right angles with respect to each other to define a regular mesh, comprising approximately 2 inch by 2 inch rectangles. Any one of a number of well known materials are used to fabricate the horizontal and vertical wires, such as drawn steel, nickel-copper, aluminum, or the like. Sixteen gauge, zinc coated, galvanized wire is preferred.

Furring crimps 52 are fashioned at suitable intervals along the length of the vertical wires 48 by a crimping, or stamping, mechanism (not shown). Sufficient pressure is applied to portions of the vertical wires at regularly spaced-apart intervals to form approximately v-shaped indentations, or grooves. The vertical wires are oriented with respect to the separator paper 42 so that the bottom 52*a* (or base) of each furring crimp 52 is disposed adjacent the plane of the paper and the remaining flat portions 54 of the vertical wires describe a plane offset from the plane of the paper by a distance equal to the depth of the furring crimp.

In the exemplary embodiment, a sheet of lathing is constructed by interweaving the separator paper 42 and the wire mesh. A first course of horizontal wires 50 is arranged on the front surface of the separator paper 42 so that the wires span the elongated slots 44 longitudinally. A second course of horizontal wires 56, preferably every third horizontal wire, is arranged on the back surface of the separator paper and which again longitudinally span the elongated slots 44. The vertical wires 48 are arranged on the front face of the separator paper, at right angles to the horizontal wires, and span the elongated slots transversely to their long axis. The wire pattern is designed so that all wire crossings occur within a slot area. The crossing wires are welded together, at every intersection, through the elongated slots and the backing paper 40 is spot-glued to the back of the separator paper layer 42.

As shown in FIG. 3, the wires 56 comprising the second horizontal course are welded to the vertical wires 48 at the base of the furring crimps 52. Since this course of wires is the only course arranged on the back surface of the separator paper, the intervening webs 46 between elongated slots overlap only those horizontal wires 56 which run along the base 52*a* of the furring crimps. The remaining horizontal wires 50 are not engaged by the webs and the separator paper is not drawn up against the wire mesh thereby. Accordingly, the separator paper falls away from the wire mesh and is caused to lay substantially flat.

Figure 4A:
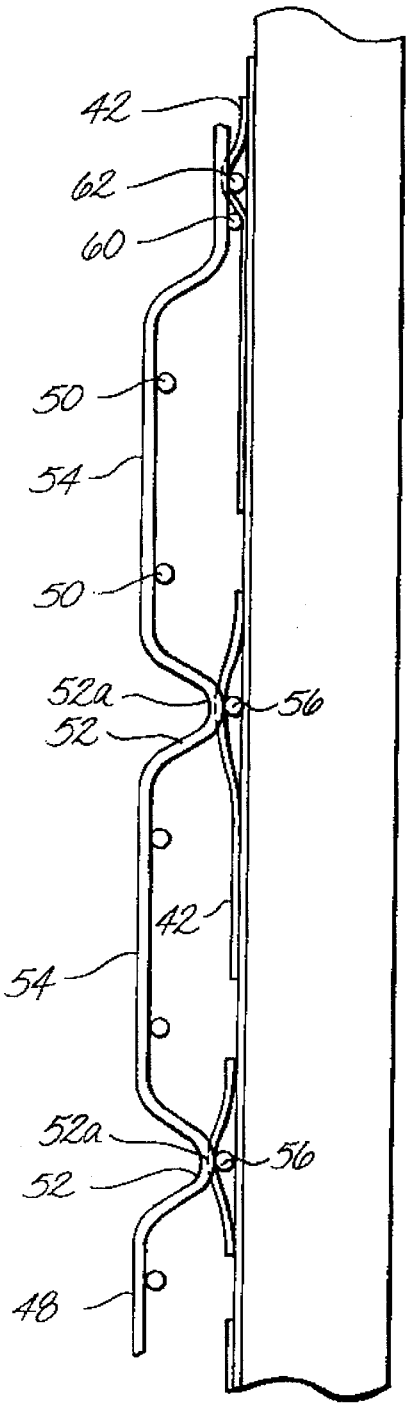
FIG. 4*a* is a semi-schematic cross-sectional view of lathing material in accordance with the invention before the application of plaster.

Turning now to FIG. 4*a*, there is shown a cross-sectional view of lathing material in accordance with the invention, as it would appear after being attached to a framing stud, but before the application of a coat of plaster. It can be seen that the separator paper 42 lays substantially flat, in the plane of the framing studs, while the bulk of wire mesh is displaced away from the framing studs, and defines, substantially, a second plane, separated from the plane of the paper and the framing studs, by the depth of the furring crimp 52. Only the base 52*a* of the furring crimps 52 and the horizontal wires 56 attached thereto are coplanar with the separator paper layer 42. The remaining horizontal wires 50 extend over the surface of the separator paper along their entire lengths at a height equal to the furring crimp depth. It is also evident from the figure that the vertical wires 48 include flat portions 54, defined as those portions not bent or indented into a furring crimp, which extend over the surface of the separator paper layer for a substantial portion of their lengths.

Lathing material, as above described, is secured at intervals to wood or metal framing members 24 such as studs or rafters by fasteners which are driven through the lathing material at any point along the horizontal extent of the base of a furring groove. The framing studs 24 provide vertical supports upon which lathing material is mounted. As can be seen from FIG. 4*a*, the backing paper and separator paper layers 40 and 42 bear against the studs as do the horizontal wires 56 welded to the base of the furring crimps 52. When mounting the lathing material prior to a plaster application, the lathing is lifted into position on the studs and fasteners are driven through the lathing material along the horizontal wires at the bearing points.

A pair of horizontal wires 60, 62 replace the single wire at the top horizontal wire course of a sheet of lathing. Wires 60, 62 are spaced apart a predetermined distance, typically one quarter of an inch, to define a continuous horizontal slot extending across the width of the sheet of lathing into which fasteners are attached to line-up or guide the lathing against the studs. A first horizontal wire 62, comprising the pair 60 and 62, spans the back surface of the separator paper and thus engages the intervening webs of the top row of slots.

A second horizontal wire 60 spans the front side of the separator paper and is therefore exposed along its entire length. Building codes require that sheets of lathing material overlap one another by one entire metal grid height. The bottom, and next to the bottom, horizontal wires of the upper (overlapping) lathing sheet are secured to the top, and next to the top, horizontal wires of the lower (overlapped) lathing sheet.

The exposed wire 60 of the pair, functions as the top wire of the lathing sheet, to which a wire of the next (overlapping) course of lathing is attached. The first wire 60, which spans the back of the separator paper, functions to hold the separator paper in place behind the top portion of the wire mesh. Were the first wire not provided, the paper material could fall away from the top of the lathing, exposing a large open area behind the course of wires at the overlap.

Figure 4B:
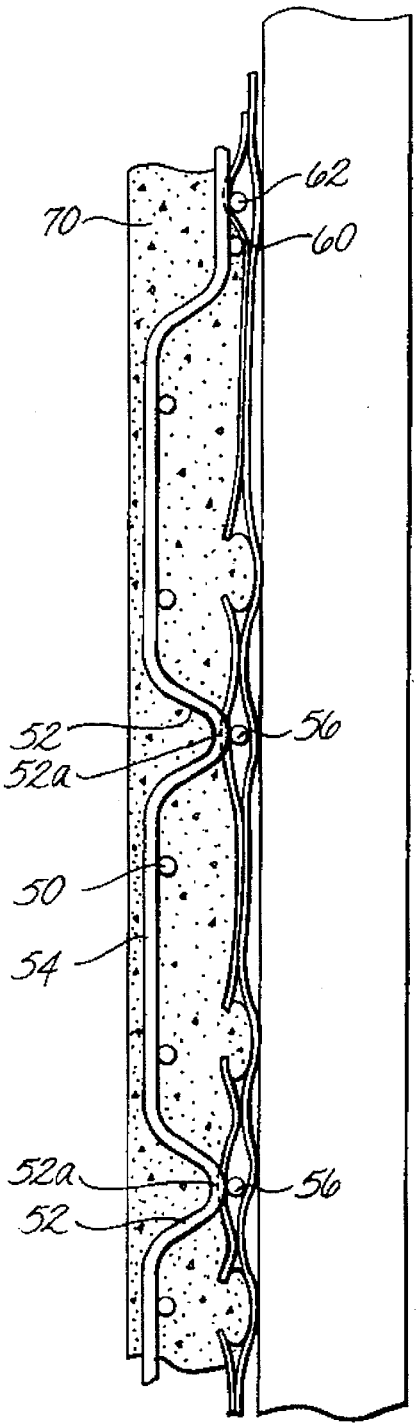
FIG. 4*b* is a semi-schematic cross-sectional view of lathing material in accordance with the invention after the application of a plaster scratch coat.

Turning now to FIG. 4*b*, there is shown a cross-sectional view of lathing material in accordance with the invention, attached to a framing stud after a plaster scratch coat layer 70 of portland cement plaster, mortar, stucco, or the like has been applied to the attached lathing. The plaster/stucco scratch coat layer can be applied either manually by a trowel, or if sufficiently fluid, by a high-pressure spray gun.

The scratch coat 70 is applied to a thickness which is intended to correspond to the depth of the furring crimps 52. In one embodiment, this depth is ¼ inch to comply with standard practices. The scratch coat plaster material is applied until the surface of the scratch coat is approximately co-extensive with the outer edges of the vertical wires. Fluid or mechanical pressure from the application of the scratch coat 70 displaces the backing material away from the wire mesh to the maximum degree allowable by the elasticity of the backing material. The scratch coat flows around and envelops the horizontal wires 50 and the vertical wire flat portions 54 which extend above the plane of the backing material. Essentially, the full ¼ inch thickness of the scratch coat is applied between the backing paper and the mesh. It is, therefore, apparent that the extended horizontal wires and the vertical wire flat portions are fully embedded along substantially their entire lengths to a depth at least equal to the depth of the furring crimps.

After allowing sufficient time for the scratch coat to cure, a second plaster/stucco coat, termed the brown coat, is applied to a thickness of from about five eights inches to three quarters inches. A final coat, the finish coat, is applied over the brown coat to give a final application thickness of from about three quarters inches to about seven eights inches. Both the scratch coat and the brown coat are applied in a manner which cause their surfaces to have a rough texture, which provides a good adherence base for subsequent layers. The final finishing layer often includes an extra quantity of fine mortar or plaster, mixed with the cement or stucco, which causes the exterior surface of the application to have a smooth finished aspect.

In the foregoing description it will be apparent that the lathing constructed according to principles of this invention is structurally characterized by the specifically constructed and functionally related openings and intervening webs of the support paper material interwoven with only selected ones of the horizontal wires comprising the welded wire mesh. The selected horizontal wires are attached to the vertical wires along the bottom of furring crimps which serve to extend the remaining flat portions of the vertical wires in a plane above the plane of the support paper.

Accordingly, substantially the entire lengths of the flat portions of the vertical wires are embedded in plaster to the depth of the furring crimp. The horizontal wires not attached at the bottom of a furring crimp are also embedded in plaster to at least the depth of the furring crimp.

In contrast to the prior art lathing, welded wire lathing constructed in accordance with the invention has two different courses of horizontal wires; a first course spanning the back side of the separator paper, thereby engaging the paper to the wire mesh, and a second course spanning the front side of the paper and raised above the plane of the paper to allow the full thickness of the scratch coat is applied between the paper and the wire mesh.

Thus, the bulk of the wire mesh is fully embedded in the plaster scratch coat, and a uniformly strong reinforcement is provided in two directions throughout the area of the lathing.

Although a preferred embodiment of self-furring, welded wire lathing has been specifically described and illustrated herein, many modifications and variations will be apparent to those skilled in the art. In particular, furring crimps may be provided at closer or longer intervals than those illustrated. The vertical wires may be crimped at locations corresponding to every other horizontal wire, every fourth horizontal wire, every fifth, or the like. The horizontal wires welded to the base of the crimps serves to engage corresponding webs of paper material and thereby secure the paper to the wire mesh.

Increasing the periodicity of the furring crimps, and thereby the periodicity of engagement between the paper and the mesh, would strengthen the composite lathing material at the expense of the numbers of wires and their lengths fully embedded in a mortar application. Reducing the periodicity would increase the number of wires embedded at the cost of some reduction in composite material strength.

Moreover, the crimps need not be v-shaped, but may be any shape that causes an indentation to be formed in a wire. A stretched u-shape with an elongated bottom, a rectilinear shape with a square section, or the like, may serve as a furring crimp without departing from the spirit of this invention.

Accordingly, it is to be understood that the lathing according to principles of this invention may be embodied other than as specifically described herein. The scope of the invention is defined only by the scope of the appended claims.

What is claimed is:

1. Welded wire lathing of a self-furring type comprising:

a flexible support material having front and back faces and disposed substantially in a plane, the support material including horizontally spaced-apart elongated openings arranged in parallel rows wherein the spacing between said openings define intervening webs therebetween; and a metal reinforcing mesh interwoven with the support material, said mesh including a plurality of horizontal and vertical wires disposed in equally spaced-apart perpendicular relation and welded together at their intersections, the vertical wires spanning the openings transversely on the front face of said support material, the horizontal wires spanning the openings longitudinally, wherein the horizontal wires comprise a first wire course which spans the openings along the front face of the support material and a second wire course which spans the openings along the back face of the support material, said second wire course thereby engaging corresponding intervening webs to attach the support material to the wire mesh.

2. Lathing according to claim 1, wherein said flexible support material comprises an absorbent paper separator layer.

3. Lathing according to claim 2, wherein said absorbent paper separator layer is adhesively attached to a backing layer.

4. Lathing according to claim 2, wherein said elongated openings are formed in said absorbent paper separator layer.

5. Lathing according to claim 1, wherein said vertical wires comprise alternating crimped portions and flat portions, the crimped portions forming substantially v-shaped indentations, the second horizontal wire course intersecting said vertical wires at the bottom of the crimped portions.

6. Lathing according to claim 5, wherein said first horizontal wire course intersects said vertical wires at the flat portion, the first horizontal wire course and the vertical wire flat portions together defining a plane displaced from the plane of the support material by a distance equal to the depth of the crimped portion.

7. Welded wire lathing of a self-furring type comprising:

a flexible support material defining a first plane and including longitudinally spaced-apart elongated openings arranged in parallel rows wherein confronting ends of said openings are separated to define intervening webs therebetween;

a metal reinforcing mesh interwoven with the support material comprising;

first wires transversely spanning the openings on a front face of the support material, the first wires including flat portions alternating with crimped portions, the flat portions disposed in a second plane parallel to and separated from the first plane, the crimped portions extending from the second plane to the first plane;

second wires, longitudinally spanning the openings on a front face of the support material and welded to the first wire flat portions at the intersections therebetween, the first wires thereby supporting the second wires in the second plane; and third wires, longitudinally spanning the openings on a back face of the support material and welded to the first wire crimp portions at the intersections therebetween.

8. Lathing according to claim 7, wherein said flexible support material comprises an absorbent paper separator layer.

9. Lathing according to claim 8, wherein said absorbent paper separator layer is adhesively attached to a backing layer.

10. Lathing according to claim 8, wherein said elongated openings are formed in said absorbent paper separator layer.

11. Lathing according to claim 7, wherein said first wire crimped portions form substantially v-shaped indentations, the third wires intersecting said first wires at the bottom of the crimped portions.

12. Lathing according to claim 7, wherein the second plane is displaced from the first plane by a distance sufficient to cause the first wire flat portions to be completely embedded along their lengths in an application of mortar.

13. Lathing according to claim 7, wherein the second plane is displaced from the first plane by a distance sufficient to cause the second wires to be completely embedded along their entire lengths in an application of mortar.

14. Welded wire lathing of a self-furring type comprising:

a flexible support material defining a first plane and having longitudinally spaced-apart elongated openings arranged in parallel rows;

a metal reinforcing fabric including first and second sets of wires disposed in equally spaced-apart perpendicular relation and welded together at their intersections, the first set of wires spanning the openings transversely on a front face of the support material, the second set of wires spanning the openings longitudinally, wherein the second wire set comprises a first wire type spanning the openings on the same face as the first wire set and a second wire type, parallel to the first wire type and spanning the openings on a back face of the support material, the first wire set supporting the first wire type in a second plane parallel to and separated from the first plane.

15. Lathing according to claim 14, wherein the second plane is displaced from the first plane by a distance sufficient to cause the first wire set to be completely embedded along substantially their lengths in an application of mortar.

16. Lathing according to claim 14, wherein the second plane is displaced from the first plane by a distance sufficient to cause the first wire type to be completely embedded along their entire lengths in an application of mortar.

17. Lathing according to claim 14, wherein the wires of the first set comprise flat portions alternating with crimped portions, the flat portions disposed in the second plane, the crimped portions extending from the second plane to the first plane.

18. Lathing according to claim 17, wherein the crimped portions form substantially v-shaped indentations, the second wire type intersecting the first wire set at the bottom of the crimped portions.

19. Welded wire lathing of a self-furring type comprising:

a flexible support material having top and bottom ends and front and back faces, the support material disposed substantially in a vertical plane and having horizontally spaced-apart openings therethrough, the openings arranged in parallel horizontal rows, wherein the spacing between adjacent openings in said horizontal rows define intervening webs therebetween; and a metal reinforcing grid interwoven with the support material, said grid comprising a plurality of horizontally disposed wires spaced vertically apart from each other and a plurality of vertically disposed wires spaced apart horizontally from each other, the horizontal and vertical wires being welded together at their intersections, with each such weld in registry with one of the openings, the vertical wires disposed across the front face of the support material, wherein the horizontal wires comprise two wire courses, a first horizontal wire course disposed across the front face of the support material and a second horizontal wire course disposed across the back face of the support material, the wires of the second wire course engaging the webs to thereby attach the support material to the wire grid.

* * * * *

UNITED STATES PATENT AND TRADEMARK OFFICE

CERTIFICATE OF CORRECTION

PATENT NO. : 5,540,023
DATED : July 30 1996
INVENTOR(S) : Howard W. Jaenson

It is certified that error appears in the above-identified patent and that said Letters Patent is hereby corrected as shown below:

On the title page, Item [56] Referencess Cited, under "U.S. PATENT DOCUMENTS" insert the following references:

| | | | | |
|---|---|---|---|---|
| -- | 2,166,443 | 7/1939 | Karelius . . . | 72/116 |
| | 2,236,141 | 3/1941 | Karelius . . . | 72/116 |
| | 2,375,302 | 5/1945 | Karelius . . . | 72/116 |
| | 2,375,303 | 5/1945 | Karelius . . . | 72/116 |
| | 2,408,781 | 10/1946 | Karelius . . . | 72/116 -- |

also insert:

-- OTHER PUBLICATIONS
Advertising brochure entitled "K-Lath®". --

Column 1, line 51, after "registry" insert -- with --.
Column 3, line 14, after "will" insert -- be --.
Column 3, line 19, change "cross sectional" to -- cross-sectional --.
Column 4, line 23, after "withstand" delete "a".
Column 4, line 42, after "rows" insert a period.
Column 6, line 15, change "nickel-" to -- nickel, --.
Column 7, line 40, change "60" to -- 62 --.
Column 8, lines 7,8, change "five eights inches to three quarters inches" to -- five eighths inch to three quarters inch --.

UNITED STATES PATENT AND TRADEMARK OFFICE

CERTIFICATE OF CORRECTION

PATENT NO. : 5,540,023
DATED : July 30 1996
INVENTOR(S) : Howard W. Jaenson

It is certified that error appears in the above-identified patent and that said Letters Patent is hereby corrected as shown below:

Column 8, lines 9,10, change "three quarters inches to about seven eights inches" to -- three quarters inch to about seven eighths inch --.
Column 8, line 38, replace "coat is applied" with -- coat to be applied --.

Signed and Sealed this

Eleventh Day of January, 2000

*Attest:*

Q. TODD DICKINSON

*Attesting Officer*

*Acting Commissioner of Patents and Trademarks*

US005540023B1

REEXAMINATION CERTIFICATE (4176th)

United States Patent [19] [11] B1 5,540,023

Jaenson [45] Certificate Issued Oct. 17, 2000

[54] LATHING

[75] Inventor: Howard W. Jaenson, Covina, Calif.

[73] Assignee: Jaenson Wire Company, Fontana, Calif.

Reexamination Request:
No. 90/005,367, May 24, 1999

Reexamination Certificate for:

| | |
|---|---|
| Patent No.: | **5,540,023** |
| Issued: | **Jul. 30, 1996** |
| Appl. No.: | **08/479,136** |
| Filed: | **Jun. 7, 1995** |

Certificate of Correction issued Jan. 11, 2000.

[51] Int. Cl.[7] ..... E04F 13/04
[52] U.S. Cl. ..... 52/343; 52/344
[58] Field of Search ..... 52/342–344

[56] References Cited

PUBLICATIONS

ICBO Evaluation Service, Inc. Evaluation Report No. 4369, Dec. 1992.

*Primary Examiner*—Beth Stephan

[57] ABSTRACT

Self-furring, welded wire lathing includes a flexible paper support material disposed substantially in a vertical plane and having horizontally spaced-apart openings cut therethrough. The openings are arranged in parallel horizontal rows, with the spacing between adjacent openings in each horizontal row defining intervening webs of support paper therebetween. A metal reinforcing grid is interwoven with the support material, and includes a regular array of horizontal and vertical wires which are welded together at their intersections, with each such weld in registry with one of the openings. The vertical wires are arranged across the front face of the support material, while the horizontal wires are arranged in two wire courses; a first horizontal wire course arranged across the front face of the support material and a second horizontal wire course arranged across the back face of the support material. The wires of the second horizontal wire course engage the paper webs to thereby attach the support material to the wire grid. The wires of the first horizontal wire course are held away from the support material by furring crimps in the vertical wires, thus allowing a full thickness of plaster to be applied between the support paper and the wire mesh to the depth of the fur.

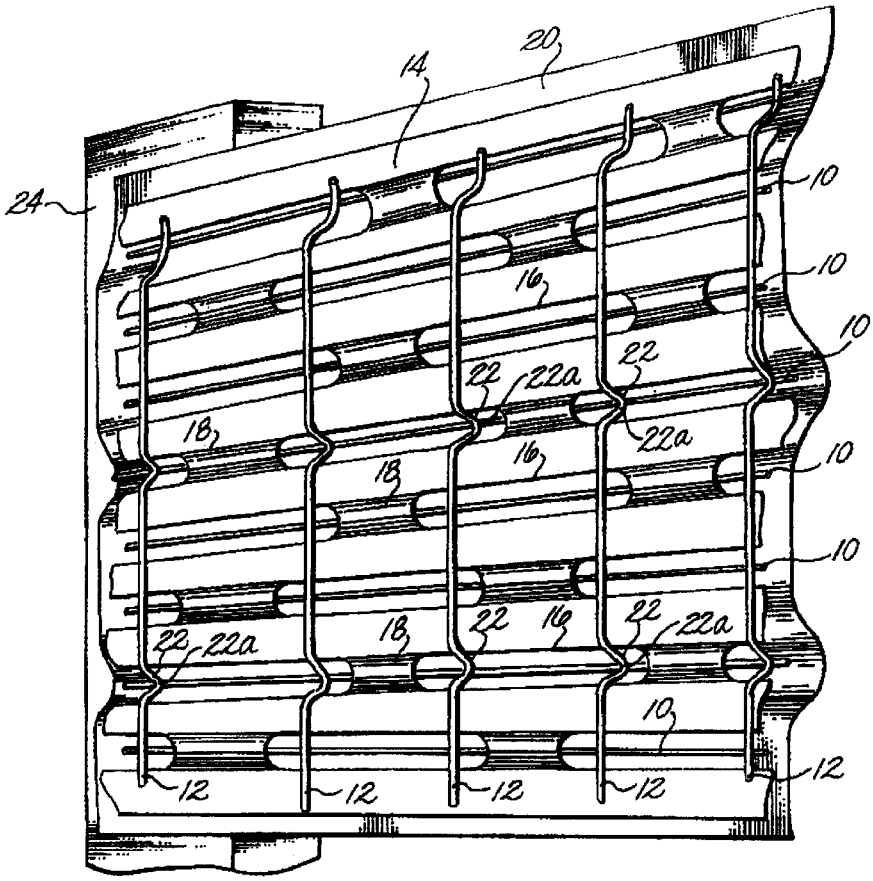

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–19 is confirmed.

* * * * *